US010071399B2

(12) United States Patent
Perlas et al.

(10) Patent No.: US 10,071,399 B2
(45) Date of Patent: Sep. 11, 2018

(54) ARTICLE FOR SCRUBBING AND CLEANING HARD SURFACES AND A METHOD FOR USE THEREOF

(71) Applicant: THE CLOROX COMPANY, Oakland, CA (US)

(72) Inventors: Kristina Perlas, Pleasanton, CA (US); Jared Heymann, Pleasanton, CA (US); Steven J. Tomkins, Hershey, PA (US); Rashda Khan, Goleta, CA (US); Aidee Duarte, Pleasanton, CA (US); Kerry D. Azelton, Pleasanton, CA (US); Abhishek Shetty, Pleasanton, CA (US); Arun Agarwal, Pleasanton, CA (US); Sacha Connor, Pleasanton, CA (US); Miranda Helmer, Pleasanton, CA (US); Selina Wang, Pleasanton, CA (US); Hyunjoo Lee, Seoul (KR); Courtney Lytle, San Francisco, CA (US); John Jamieson, Pleasanton, CA (US); Janiece Hope, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 430 days.

(21) Appl. No.: 14/876,700

(22) Filed: Oct. 6, 2015

(65) Prior Publication Data

US 2016/0096204 A1 Apr. 7, 2016

Related U.S. Application Data

(60) Provisional application No. 62/060,457, filed on Oct. 6, 2014.

(51) Int. Cl.
*B43K 5/02* (2006.01)
*B08B 3/10* (2006.01)
(Continued)

(52) U.S. Cl.
CPC ..... *B08B 3/10* (2013.01); *A47L 13/17* (2013.01); *C11D 17/041* (2013.01); *C11D 17/049* (2013.01)

(58) Field of Classification Search
CPC ..... A47L 13/17
(Continued)

(56) References Cited

U.S. PATENT DOCUMENTS 41,700 A 2/1864 Hamilton et al.
D101,784 S 11/1936 Kurtz
(Continued)

FOREIGN PATENT DOCUMENTS

CA 2491170 A1 6/2006
EP 0198389 B1 1/1995
(Continued)

OTHER PUBLICATIONS

Notice of Allowance dated Dec. 7, 2017; U.S. Appl. No. 29/564,853, filed May 16, 2016.
(Continued)

*Primary Examiner* — Jennifer C Chiang
(74) *Attorney, Agent, or Firm* — Alok Goel

(57) ABSTRACT

An all-in-one cleaning device, e.g., such as may be used in cleaning the inside of a shower. The device may provide the ability to dispense the composition carried within the device itself, and scrub the composition into or against the surfaces to be cleaned (e.g., shower walls, floors, corners, etc.). Activation of the dispensing mechanism of the cleaning device may dispense a metered dose of composition, in a generally horizontal direction, onto and/or into a nonwoven or other substrate. The dispensing mechanism may not rely on gravity for dispensing, and may be sealed to prevent unwanted backflow of shower water or other material, preventing contamination.

16 Claims, 7 Drawing Sheets

(51) Int. Cl.
*A47L 13/17* (2006.01)
*C11D 17/04* (2006.01)

(58) Field of Classification Search
USPC ..... 401/188 R
See application file for complete search history.

(56) References Cited

U.S. PATENT DOCUMENTS 2,557,267 A 6/1951 Ellinger
D301,204 S 5/1989 Cramer
4,850,729 A 7/1989 Kramer et al.
D321,930 S 11/1991 Dinand
D329,607 S 9/1992 Dinand
5,165,811 A 11/1992 MacLeod
D344,231 S 2/1994 Gagnon
5,454,659 A 10/1995 Vosbikian et al.
D373,955 S 9/1996 Boxer
5,656,226 A 8/1997 McVicker
D395,598 S 6/1998 Van Lit et al.
D398,427 S 9/1998 Berti
D409,915 S 5/1999 Durliat et al.
5,915,869 A 6/1999 Agosto et al.
D439,053 S 3/2001 Hay
6,224,283 B1 5/2001 Hay
D459,650 S 7/2002 Gagnon
6,425,701 B1 7/2002 Jacobs
D473,382 S 4/2003 Dutra
D477,917 S 8/2003 Giacolo et al.
6,685,376 B2 * 2/2004 Weihrauch ..... A47L 13/16 15/244.1
D496,202 S 9/2004 Hansen
D501,085 S 1/2005 Hay
6,842,936 B2 1/2005 Policicchio et al.
6,983,866 B2 1/2006 Smart et al.
6,998,373 B1 2/2006 Faines, Jr. et al.
D524,546 S 7/2006 Ajluni et al.
7,131,902 B2 11/2006 Hope
7,264,414 B2 9/2007 McReynolds et al.
D556,408 S 11/2007 Lang et al.
D562,011 S 2/2008 Meyer
D564,353 S 3/2008 Ruiz De Gopegui et al.
D565,948 S 4/2008 Maas et al.
D569,723 S 5/2008 Sellick
D578,262 S 10/2008 Trotter et al.
D578,720 S 10/2008 Norcorn et al.
D580,274 S 11/2008 Abel
7,446,082 B2 11/2008 Kilkenny et al.
D583,156 S 12/2008 Constantine
D583,566 S 12/2008 Meyer
7,470,652 B2 12/2008 Kilkenny et al.
7,536,743 B2 5/2009 Goh et al.
7,540,056 B2 6/2009 Dotterman et al.
7,553,221 B2 6/2009 Hope et al.
D602,779 S 10/2009 Buogo et al.
7,610,647 B2 11/2009 Morgan et al.
7,682,097 B2 3/2010 Knopow et al.
D617,198 S 6/2010 Lee et al.
7,837,403 B2 11/2010 Willinger et al.
D628,481 S 12/2010 Maddy
D632,587 S 2/2011 Richmond
D636,860 S 4/2011 Abbondanzio et al.
D640,850 S 6/2011 Koenig et al.
8,025,453 B2 * 9/2011 Chan ..... B60S 3/047 401/188 R
D650,290 S 12/2011 Natsume et al.
D653,540 S 2/2012 Sweeton
D653,947 S 2/2012 Arminak
D655,199 S 3/2012 Ciriani
D656,413 S 3/2012 Hayton et al.
D658,063 S 4/2012 Simmons
8,167,510 B2 * 5/2012 LaFlamme ..... A45D 34/04 401/188 R
8,627,986 B2 1/2014 Bradbury et al.
8,648,027 B2 * 2/2014 Mitchell ..... C11D 3/48 510/295
8,684,619 B2 4/2014 Uchiyama et al.
D705,649 S 5/2014 Sweeton
8,763,616 B2 7/2014 Koptis et al.
8,834,055 B2 9/2014 Uchiyama et al.
D714,648 S 10/2014 Kersten
D717,666 S 11/2014 Palm et al.
8,888,395 B1 11/2014 Hinnant
8,910,343 B2 * 12/2014 Huber ..... A47L 11/4086 15/320
D740,568 S 10/2015 Shafer et al.
D745,234 S 12/2015 Brown
D745,402 S 12/2015 Lovegrove
D764,309 S 8/2016 Yakos
D770,800 S 11/2016 Agarwal et al.
D805,391 S 12/2017 Azelton et al.
2003/0074756 A1 4/2003 Pollicicchio et al.
2003/0104962 A1 6/2003 Verherbrugghen et al.
2004/0101347 A1 5/2004 Beard
2004/0117935 A1 6/2004 Cavalheiro
2004/0140326 A1 7/2004 Smart
2004/0265042 A1 * 12/2004 Chan ..... A46B 11/0055 401/270
2005/0039293 A1 2/2005 McReynolds et al.
2005/0069375 A1 3/2005 Kliegman
2005/0155628 A1 7/2005 Kilkenny et al.
2005/0155631 A1 7/2005 Kilkenny et al.
2005/0229344 A1 10/2005 Mittelstaedt et al.
2006/0032944 A1 2/2006 Hornsby et al.
2006/0048318 A1 3/2006 Goh et al.
2006/0048319 A1 3/2006 Morgan et al.
2006/0133886 A1 6/2006 Willinger
2006/0154582 A1 7/2006 Hope
2006/0168748 A1 8/2006 Dotterman et al.
2006/0168750 A1 8/2006 Dotterman et al.
2006/0233592 A1 10/2006 Knopow et al.
2007/0082591 A1 4/2007 Hope et al.
2007/0094827 A1 5/2007 Kilkenny
2007/0094829 A1 5/2007 Dotterman et al.
2007/0191252 A1 8/2007 Kilkenny et al.
2007/0191253 A1 8/2007 Kilkenny et al.
2008/0098546 A1 5/2008 Warmka et al.
2008/0115302 A1 5/2008 Kilkenny et al.
2008/0205965 A1 8/2008 LaFlamme et al.
2008/0264972 A1 10/2008 LaFlamme
2008/0267689 A1 10/2008 Soller et al.
2008/0317389 A1 * 12/2008 Pung ..... A47L 13/17 383/38
2009/0038092 A1 2/2009 Kennedy et al.
2009/0165228 A1 7/2009 Kilkenny et al.
2011/0243643 A1 10/2011 Huang
2012/0096662 A1 4/2012 Uchiyama et al.
2012/0301208 A1 11/2012 Hughes et al.
2012/0301210 A1 11/2012 Sturgis et al.
2013/0043329 A1 2/2013 Bradbury
2013/0047358 A1 2/2013 Shafer et al.
2013/0047361 A1 2/2013 Meili et al.
2013/0047362 A1 2/2013 Steinhardt et al.
2013/0047363 A1 2/2013 Steinhardt et al.
2013/0340186 A1 12/2013 Uchiyama et al.
2014/0230847 A1 8/2014 Pung
2014/0259499 A1 9/2014 Post
2014/0259500 A1 9/2014 Post
2014/0259501 A1 9/2014 Post
2014/0265056 A1 9/2014 Kozak et al.
2014/0290695 A1 10/2014 Uchiyama et al.
2015/0068371 A1 3/2015 Terrelonge
2015/0121637 A1 5/2015 Brenner
2015/0139721 A1 5/2015 Conway
2015/0297045 A1 10/2015 Marsh
2016/0096204 A1 4/2016 Perlas et al.
2016/0199162 A1 7/2016 Brilliant
2016/0220088 A1 8/2016 Zohar et al.

(56) References Cited

U.S. PATENT DOCUMENTS

| | | | | |
|---|---|---|---|---|
| 2016/0235272 | A1 | 8/2016 | Azelton et al. | |
| 2017/0172380 | A1* | 6/2017 | Sampaio | A47L 25/00 |

FOREIGN PATENT DOCUMENTS

| | | | |
|---|---|---|---|
| WO | 0162122 | A2 | 8/2001 |
| WO | 2004020151 | A1 | 3/2004 |
| WO | 2010032105 | A1 | 3/2010 |
| WO | 2014143415 | A1 | 9/2014 |

OTHER PUBLICATIONS

NonFinal Office Action dated Dec. 30, 2016, U.S. Appl. No. 15/097,077, filed Apr. 12, 2016.

Office Action dated Feb. 9, 2018; U.S. Appl. No. 15/138,052; filed Apr. 25, 2016.

Office Action dated Mar. 14. 2018; U.S. Appl. No. 15/097,077, filed Apr. 12, 2016.

Office Action dated Feb. 22, 2018; U.S. Appl. No. 29/564,854, filed May 16, 2016.

* cited by examiner

ARTICLE FOR SCRUBBING AND CLEANING HARD SURFACES AND A METHOD FOR USE THEREOF

CROSS-REFERENCE TO RELATED APPLICATIONS

The present application claims the benefit of U.S. Patent Application Ser. No. 62/060,457, filed Oct. 6, 2014 and entitled "ARTICLE FOR SCRUBBING AND CLEANING HARD SURFACES AND A METHOD FOR USE THEREOF", the disclosure of which is incorporated by reference in its entirety.

BACKGROUND OF THE INVENTION

1. The Field of the Invention

The present invention relates to cleaning devices, particularly to devices for cleaning of hard surfaces, such as shower walls.

2. Description of Related Art

Nearly every consumer is familiar with the necessary but undesirable task of cleaning the shower or bathtub. Various devices and methods have been employed in cleaning showers, bathtubs, and other hard surfaces, although a continuing need exists for improved devices and methods.

BRIEF SUMMARY

One aspect of the present invention relates to a cleaning device capable of dispensing a finite metered amount of cleaning composition (e.g., a liquid or gel) from a sealed container housing onto an attached (e.g., nonwoven) substrate. The container housing includes a reservoir into which the cleaning composition is loaded (e.g., prefilled during manufacture, filled by a consumer). The cleaning device may include a pump assembly configured to spray the composition, and an actuator operably connected thereto, so that upon actuation a metered dose of the cleaning composition is sprayed through a dispensing orifice of the pump assembly, onto the substrate (e.g., one or more of nonwoven, woven, foam, sponge, cellulose material). The substrate material may be abrasive or soft depending on the cleaning application, or desired characteristics.

In an embodiment, the cleaning device includes a container housing including a reservoir for holding a cleaning composition, an actuator disposed at a top end of the container housing, a pump assembly at least partially disposed within the container housing and in fluid communication with the cleaning composition within the reservoir. The actuator may be operably coupled to the pump assembly and may be configured to dispense a metered dose of the cleaning composition from the reservoir through a dispensing orifice, into the substrate. The substrate may be attached to a scrubbing surface (also referred to herein as a scrubbing side) of the container housing, the substrate being disposed over or about the dispensing orifice so that upon actuation of the actuator (e.g., a button), the cleaning composition is dispensed from the reservoir, through the dispensing orifice, and into the substrate.

In an embodiment, the cleaning device includes a container housing including a reservoir for holding a cleaning composition, an actuator that may be disposed at a top end of the container housing, configured to be actuated by a finger (e.g., index finger) of a user as the user grips the container housing. A pump assembly may be at least partially disposed within the container housing and be in fluid communication with the cleaning composition within the reservoir. The actuator may be operably coupled to the pump assembly and configured to dispense a metered dose of the cleaning composition from the reservoir through a dispensing orifice into a substrate upon actuation of the actuator by the user. The substrate may be provided attached to a generally vertical scrubbing side of the container housing when the container housing is oriented upright, against a shower wall or other vertical hard surface to be cleaned. The substrate may be disposed over or about the dispensing orifice, and the dispensing orifice may be oriented generally horizontally relative to the generally vertical scrubbing surface when the container housing is oriented upright, against the shower wall or other vertical hard surface to be cleaned. Upon actuation of the actuator, the cleaning composition may be dispensed from the reservoir, through the dispensing orifice, and into the substrate.

The device advantageously may provide for a metered dose of the cleaning composition, sprayed onto or into the substrate (e.g., a nonwoven), with the dispensing orifice and associated delivery channel in a generally horizontal orientation. Often, existing dispensing systems have difficulty dispensing a composition when the delivery channel and dispensing orifice is generally horizontal, as provided herein. The device may be employed for dispensing the cleaning composition in a variety of orientations and/or angles, e.g., as would exist when pressing the substrate on the scrubbing surface against a shower wall, a bathtub, a shower shelf, shower or bathtub floor, ceiling, etc. Thus, no matter the orientation of the device, the delivery channel and the dispensing orifice, actuation of the actuator may be effective to cause dispensing of the desired metered, unit dose of the cleaning composition to the substrate, where it can then be scrubbed against the surface to be cleaned. The system may advantageously be sealed, so as to prevent contamination of the cleaning composition as might otherwise occur through backflow of cleaning composition and/or water (e.g., shower water) back into the reservoir. This may be of particular benefit where the device is used while the user is showering, in the flow of the shower water. For example, the pump assembly may include a one-way valve to prevent such backflow.

The device may further be configured for use and prolonged storage within a relatively high humidity environment (e.g., in the shower), without degradation of any adhesive between the substrate and the scrubbing side of the container housing. For example, many adhesives are not compatible with prolonged storage and use in such high humidity environments, which would lead to unwanted separation between the substrate and the surface of the container housing to which the substrate is attached.

Another embodiment of the present invention is directed to a method of cleaning a shower. Such a method may include providing a cleaning device such as that described herein, and using the cleaning device to dispense the cleaning composition and clean the shower. Such cleaning (e.g., scrubbing of shower walls, shelves, floors, ceiling, etc.) may be performed immediately before, immediately after, or while the user showers (e.g., cleaning the shower in the flow of the shower water). The cleaning composition may be skin safe so as to not irritate the skin of the user to better facilitate such use.

Further features and advantages of the present invention will become apparent to those of ordinary skill in the art in view of the detailed description of preferred embodiments below.

BRIEF DESCRIPTION OF THE DRAWINGS

To further clarify the above and other advantages and features of the present invention, a more particular description of the invention will be rendered by reference to specific embodiments thereof which are illustrated in the drawings located in the specification. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

I. Definitions

Figure 1:
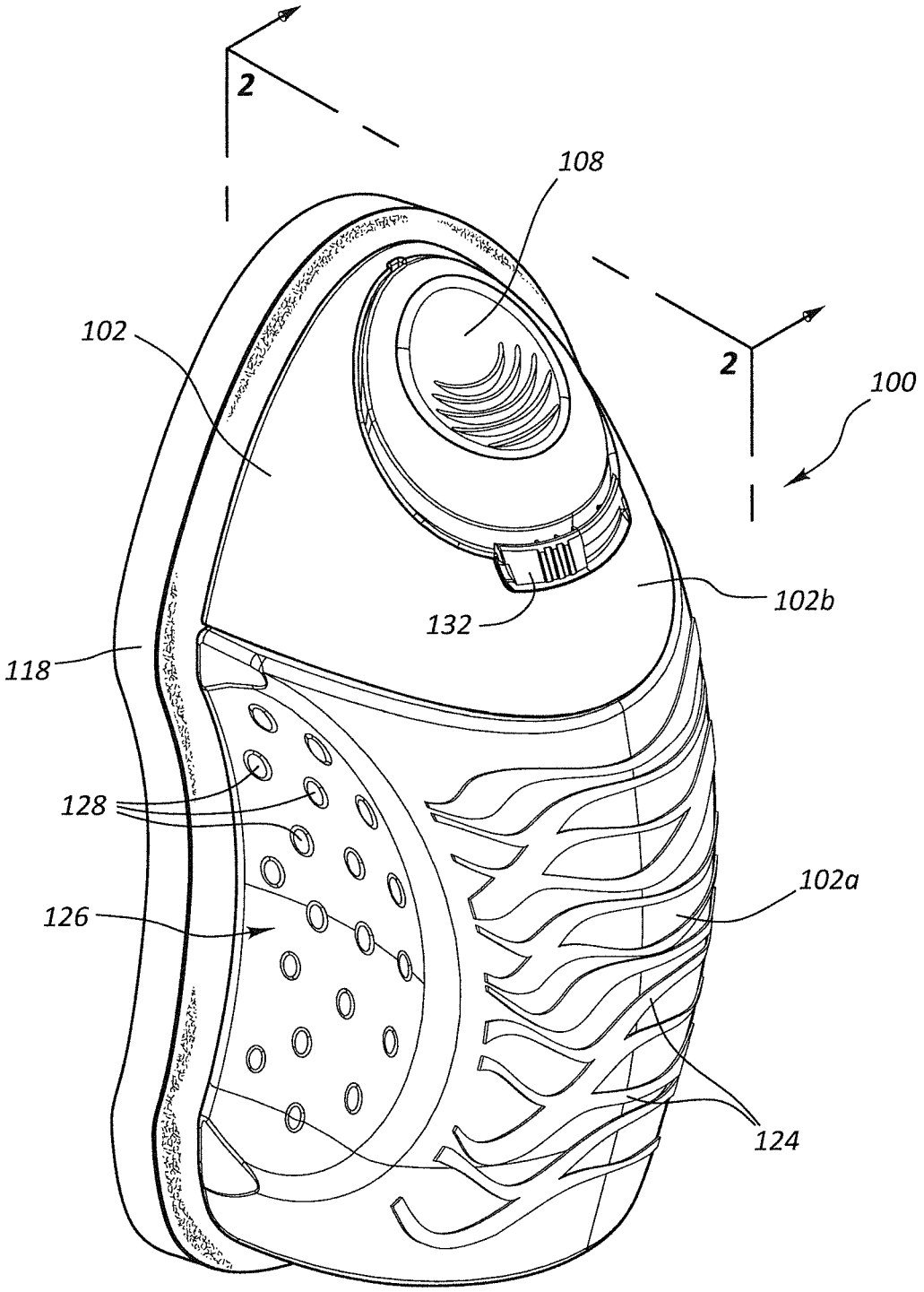
FIG. 1 is a perspective view of an exemplary cleaning device.

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

The term "comprising" which is synonymous with "including," "containing," or "characterized by," is inclusive or open-ended and does not exclude additional, unrecited elements or method steps.

The term "consisting essentially of" limits the scope of a claim to the specified materials or steps "and those that do not materially affect the basic and novel characteristic(s)" of the claimed invention.

The term "consisting of" as used herein, excludes any element, step, or ingredient not specified in the claim.

It must be noted that, as used in this specification and the appended claims, the singular forms "a," "an" and "the" include plural referents unless the content clearly dictates otherwise. Thus, for example, reference to a "surfactant" includes one, two or more surfactants.

Unless otherwise stated, all percentages, ratios, parts, and amounts used and described herein are by weight.

Numbers, percentages, ratios, or other values stated herein may include that value, and also other values that are about or approximately the stated value, as would be appreciated by one of ordinary skill in the art. A stated value should therefore be interpreted broadly enough to encompass values that are at least close enough to the stated value to perform a desired function or achieve a desired result, and/or values that round to the stated value. The stated values include at least the variation to be expected in a typical manufacturing or formulation process, and may include values that are within 25%, within 20%, within 10%, within 5%, within 1%, etc. of a stated value. Furthermore, the terms "substantially", "similarly", "about" or "approximately" as used herein represent an amount or state close to the stated amount or state that still performs a desired function or achieves a desired result. For example, the term "substantially" "about" or "approximately" may refer to an amount that is within 25%, within 20%, within 10% of, within 5% of, or within 1% of, a stated amount or value.

Some ranges may be disclosed herein. Additional ranges may be defined between any values disclosed herein as being exemplary of a particular parameter. All such ranges are contemplated and within the scope of the present disclosure.

In the application, effective amounts are generally those amounts listed as the ranges or levels of ingredients in the descriptions, which follow hereto. Unless otherwise stated, amounts listed in percentage ("%'s") are in weight percent (based on 100% active) of the cleaning composition.

As used herein, the term "substrate" is intended to include any material that is used to clean an article or a surface. Examples of cleaning substrates include, but are not limited to nonwovens, sponges, wovens, and similar materials which can be attached to the cleaning device.

As used herein, the terms "nonwoven" or "nonwoven web" means a web having a structure of individual fibers or threads which are interlaid, but not in an identifiable manner as in a knitted web. Nonwoven webs may be formed from many processes, such as, for example, meltblowing, spunbonding, needle punching and bonded carded web processes.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

II. Introduction

In an aspect, the present invention is directed to an all-in-one cleaning device, e.g., such as may be used in cleaning the inside of a shower. The device may provide the ability to dispense a cleaning composition carried within the device itself, and scrub the composition into or against the surfaces to be cleaned (e.g., shower walls, bathtub, shower shelves, floors, corners, ceilings, etc.). Activation of a dispensing mechanism (e.g., an actuator and a pump assembly) of the cleaning device may dispense a metered dose (e.g., about 0.6 cc) of composition, in a generally horizontal direction, into a nonwoven substrate. The dispensing mechanism may not rely on gravity (i.e., not gravity fed) for dispensing, and may be sealed to prevent leaking and/or unwanted backflow of shower water or other material, preventing contamination.

The cleaning device may include a container housing including a reservoir for holding a cleaning composition, an actuator, e.g., disposed at a top end of the container housing, a pump assembly at least partially disposed within the container housing and in fluid communication with the cleaning composition within the reservoir. The actuator may be operably coupled to the pump assembly and configured to dispense a metered dose of the cleaning composition from the reservoir through a dispensing orifice, onto or into a substrate. The substrate may be attached to a scrubbing surface of the container housing. The substrate may be disposed over or about the dispensing orifice so that upon actuation of the actuator, the cleaning composition is dispensed from the reservoir, through the dispensing orifice, to the substrate.

According to another aspect, the present invention provides a method of using the cleaning device. For example, the cleaning device may be used to clean the shower immediately before, immediately after, or while the user is showering (e.g., cleaning in the flow of the shower water). Such a method may include providing a cleaning device as described herein, and immediately before, immediately after, or during showering, using the cleaning device to dispense the cleaning composition and to clean the shower. As mentioned, this may be done in the flow of the shower water. The cleaning composition may be formulated so as to be skin safe so as to not irritate the skin of the user as the user cleans the shower in the flow of the shower water.

III. Exemplary Cleaning Devices

Figure 2:
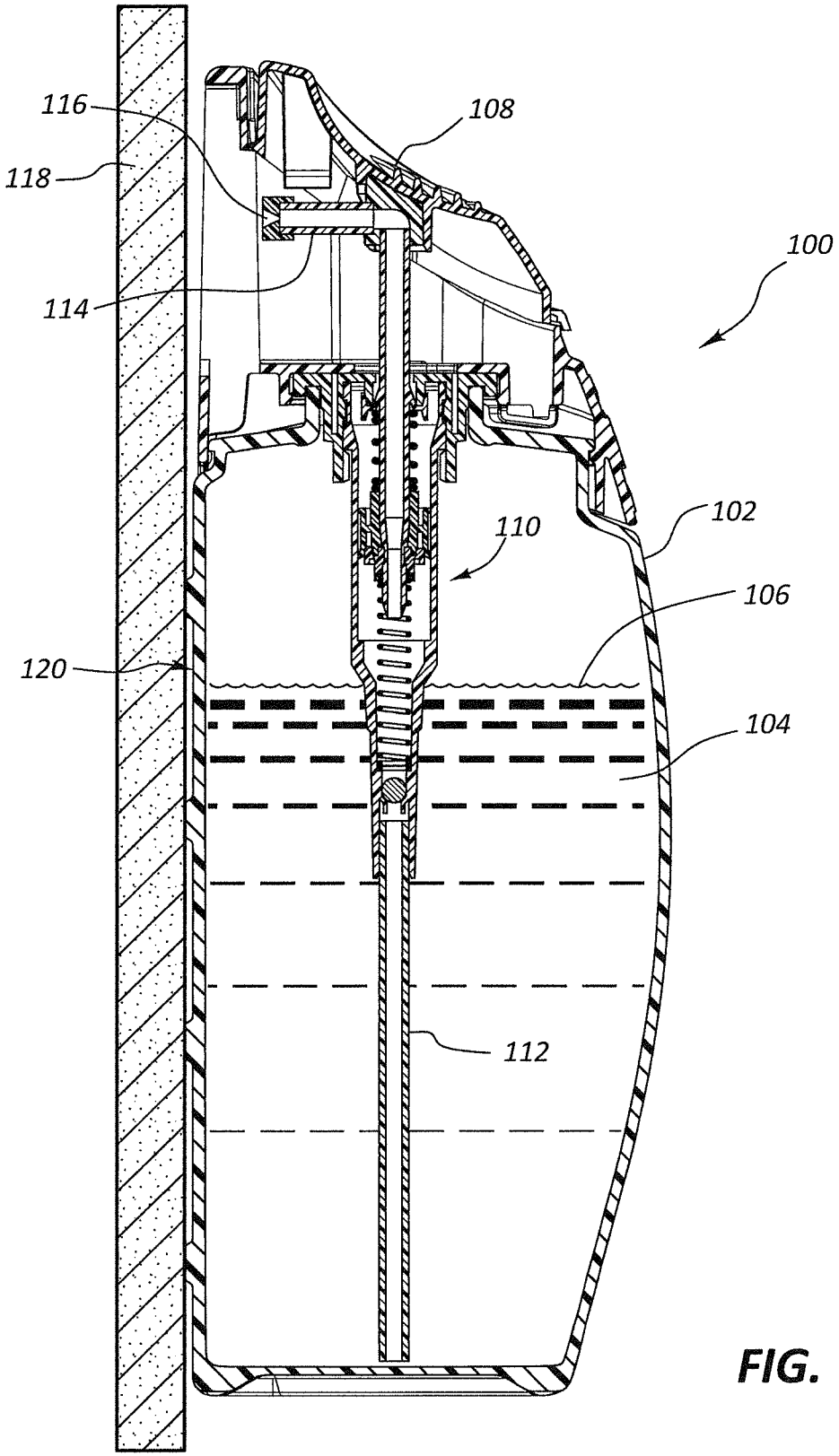
FIG. 2 is a cross-sectional view through the cleaning device of FIG. 1.
Figure 3:
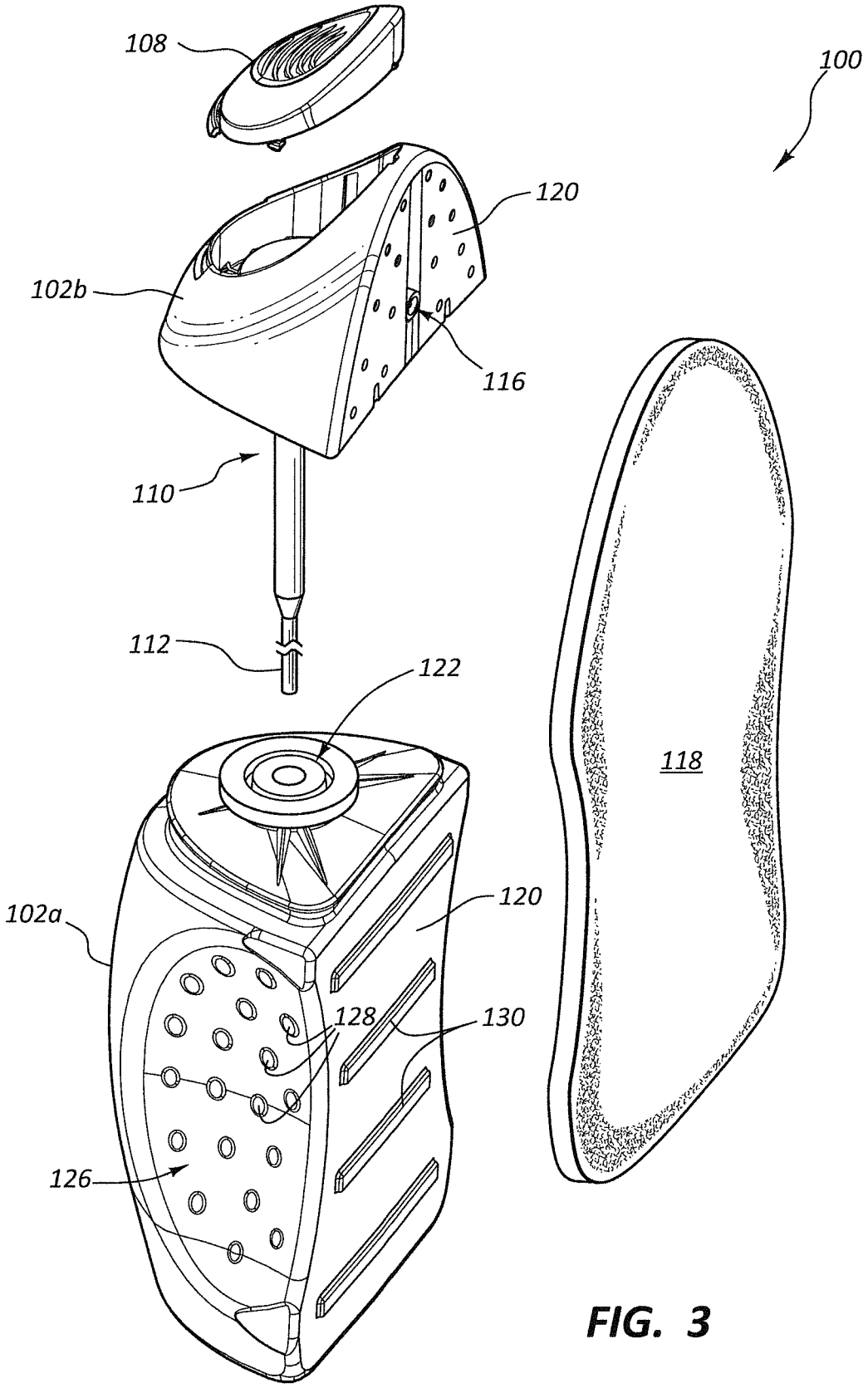
FIG. 3 is an exploded view of the cleaning device of FIG. 1.
Figure 4A:
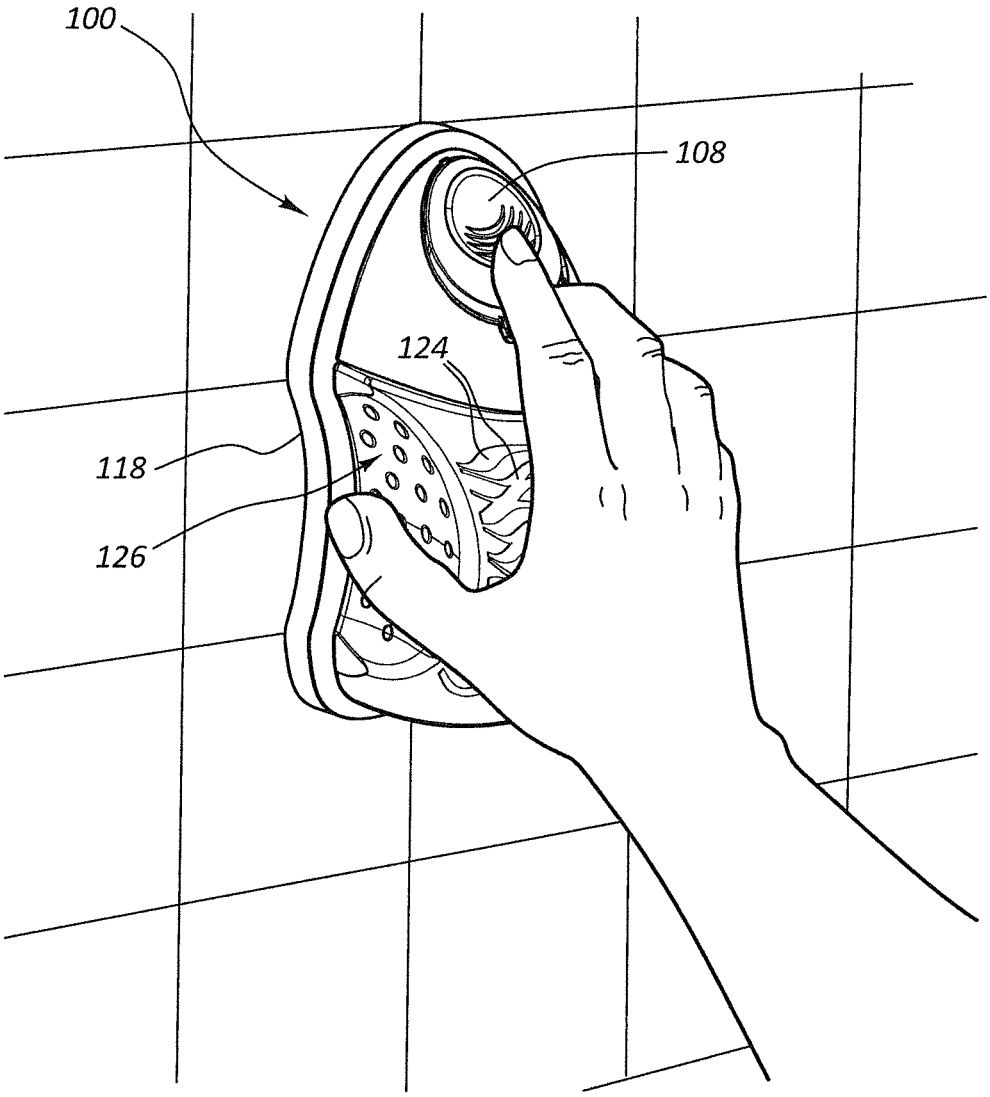
FIGS. 4A-4B show a user using the device to scrub a shower wall.

FIGS. 1-3 show an exemplary cleaning device 100 including a container housing 102 which includes a reservoir 104 for holding a cleaning composition 106. Composition 106 may be preloaded within the reservoir 104 of container housing 102, e.g., during manufacture. Cleaning device 100 may further include an actuator 108 (e.g., a button). Actuator 108 is shown as disposed at a top end of device 100, while container housing 102 is particularly shaped to provide for easy single-handed gripping of housing 102, e.g., between a thumb and fingers of a user's hand (see FIG. 4A). Positioning of actuator 108 at a top end of device 100 facilitates pressing or other actuation of actuator 108 by the user's index finger, as shown in FIG. 4A, to dispense the cleaning composition 106.

As perhaps best seen in the cross-sectional view of FIG. 2, a pump assembly 110 may be provided at least partially disposed within container housing 102, in fluid communication with cleaning composition 106. Button or other actuator 108 may be operably coupled to pump assembly 110, so as to be configured to dispense a metered dose (e.g., a calibrated amount) of the cleaning composition 106 upon pressing or otherwise actuating actuator 108. Upon pressing actuator 108, e.g., a suction force may be generated, forcing the metered amount of composition 106 up from reservoir 104, through dip tube 112, up through delivery channel 114, to dispensing orifice 116. At dispensing orifice 116, composition 106 may be sprayed or otherwise dispensed into substrate 118. As seen in FIG. 1, a lock 132 or tab other suitable mechanism may be provided to prevent inadvertent actuation of (e.g. during shipment, storage, etc.) of actuator 108.

Substrate 118 may be attached to scrubbing surface 120 of container housing 102. As seen in FIG. 2, substrate 118 may be disposed over, or about the dispensing orifice 116, so that upon actuation of actuator 108, cleaning composition 106 is dispensed from reservoir 104 through orifice 116, and into substrate 118. In an embodiment, the substrate 118 may include one or more holes through which the composition 106 is dispensed. In another embodiment, it may cover the orifice 116, so as to be dispensed directly into the substrate. Substrate 118 may comprise any suitable material that can be used to scrub and clean the surface (e.g., a shower wall, bathtub, etc.) against which it is pressed and scrubbed (e.g., moved in generally circular motions, moved up and down, or side to side, while pressing the device and substrate 118 against the surface being cleaned).

In an embodiment, substrate 118 may be nonwoven. In another embodiment it may be a foam pad, an abrasive pad, bristles, sponge, a woven material, or otherwise configured. Use of a nonwoven may aid in developing as the substrate with cleaning composition therein is scrubbed into the desired surface. In an embodiment, the substrate may be a relatively high loft material that is easily compressed when pressure is applied during the cleaning process. The high loft material may be designed to help mechanically generate foam in the cleaning composition as it is dispensed through the substrate. The substrate 118 may be absorbent, or non-absorbent (e.g., a synthetic non-absorbent). Substrate 118 may be sufficiently durable so as to be used for several uses. For example, the cleaning device 100 may be configured as an all-in one cleaning tool, prefilled with a desired amount of cleaning composition, e.g., sufficient for at least about 10, at least about 20, not more than about 50, or not more than about 40 shower cleanings (e.g., about 30 cleanings).

As shown in FIG. 1, substrate 118 may be oversized relative to the scrubbing surface 120 of container housing 102. In other words, substrate 118 may extend beyond the outer perimeter of housing 102. Such a configuration increases the surface area associated with substrate 118 for scrubbing, and also facilitates easier reach of substrate 118 into corners, particularly with the rounded or pointed top of the substrate 118 and housing 102 seen in FIG. 1.

In an embodiment, the substrate and/or cleaning composition 106 may include an antimicrobial agent therein. For example, the substrate 118 may include silver ions provided therein. An exemplary substrate may be a polyethylene terephthalate (PET) fiber blend (e.g., including various denier fibers). Suitable substrates are available from Filtrair (Heerenveen, Netherlands). In one embodiment the substrate may include a binder to adhere one or more substrate materials and/or layers together. The binder may have antimicrobial properties that aid in keeping the substrate free from bacteria or microbes between uses. Suitable examples of other antimicrobials which may be used on the nonwoven substrate, with or without a binder, include but are not limited to: SPOR-AX Antimicrobial agent provided by Fiberbond Corporation (Michigan City, Ind.) and AEGIS antimicrobial from the AEGIS Microbe Shield Technology provided by Microban International (Huntersville, N.C.) and quaternary ammonium compounds such as, 3-trimethoxy silyl propyl dimethyl octadecyl ammonium chloride. In another embodiment of the invention, the substrate materials utilize capillary and/or wicking properties to efficiently distribute the cleaning composition throughout the substrate after it is sprayed.

As shown in FIG. 2, the scrubbing surface 120 of housing 102 may include ribs or protrusions 130, or other texturing (e.g., roughened texture) on an underside thereof in order to improve bonding of substrate 118 to the scrubbing surface 120. Other than such ribs or protrusions 130, scrubbing surface 120 may be generally planar (e.g., flat). Substrate 118 may be secured to surface 120 by mechanical mechanisms (e.g., interlock between surface 120 and substrate 118), use of an adhesive, or combinations thereof. Although in an embodiment, the substrate 118 may be permanently, non-removably attached to surface 120, in another embodiment, it may be detachable (e.g., to permit replacement). Suitable attachment structures include but are not limited to: an adhesive between the substrate and the housing, a slide-on or snap-fit bracket attaching to the housing wherein the bracket attaches to substrate, a hook and loop attachment structure between the substrate and the housing, and any other suitable attachment structures. In one embodiment, the housing comprises high density polyethylene (HDPE) and soft touch which aids in allowing an adhesive to bond between the housing and the substrate material. The addition of the soft touch to the HDPE material allows the adhesive to retain the substrate in a fixed arrangement through many uses and with vigorous scrubbing.

In an embodiment, the substrate may include two or more differently configured portions. For example, bristles, or other substrate disposed at a top portion of the cleaning device may be stiffer and/or more abrasive as compared to other portions of the substrate, for use in better cleaning corners, grout lines between tiles, etc.

Figure 5A:
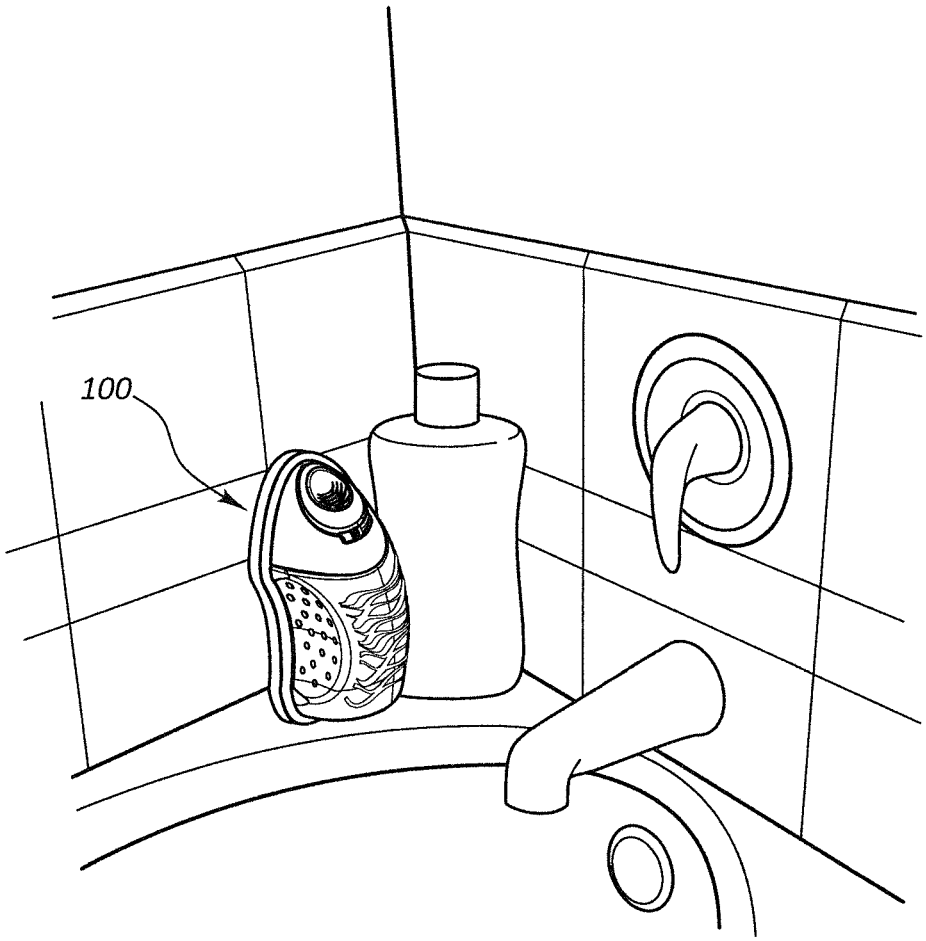
FIGS. 5A-5B shows how the device may be stored between uses in the shower and/or bathtub.
Figure 5B:
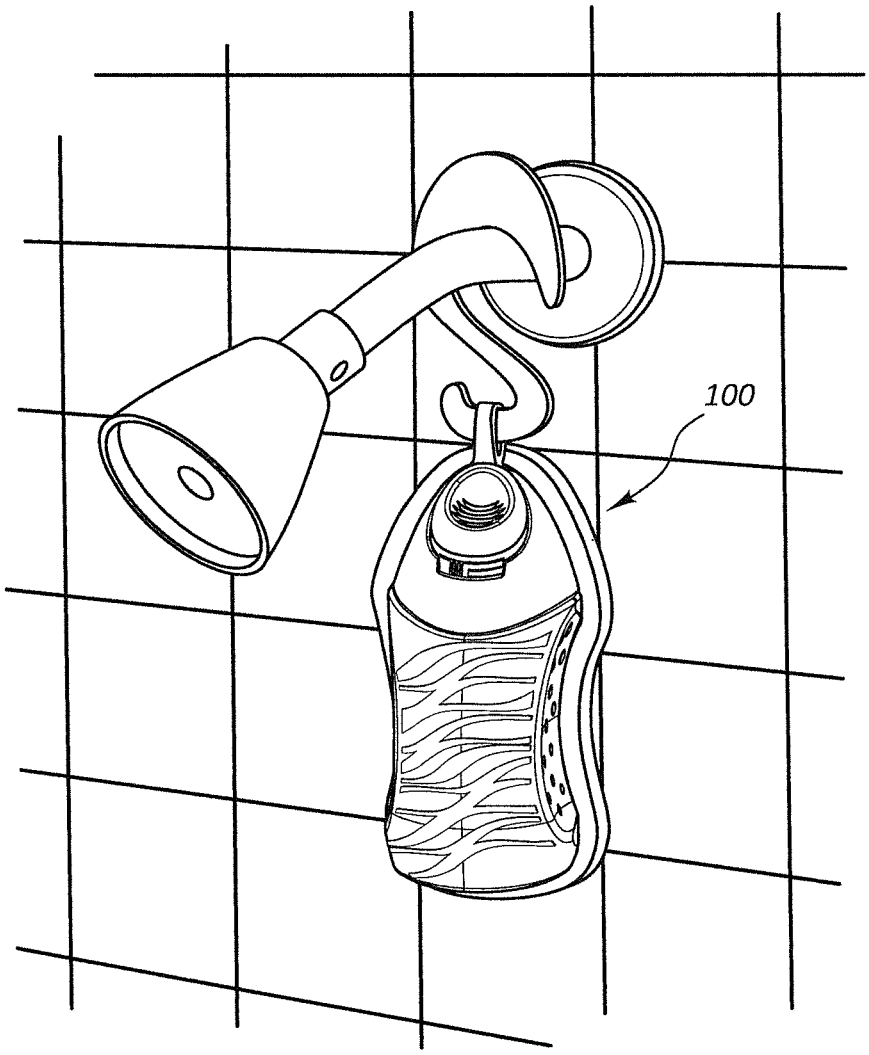

The cleaning device may be stored in the shower, as described herein and shown in FIGS. 5A-5B. In such conditions, the device, including substrate 118 and any adhesive attaching substrate 118 to surface 120 is regularly subjected to a high humidity environment. In addition, the substrate and the remainder of device 100 may often be contacted with water (e.g., flowing shower water, etc.). Many adhesives will not tolerate such conditions, but tend to peel and separate between the surfaces meant to be joined together when subjected to such conditions for an extended period. The present inventors have found that when using polyolefin-based glues with a synthetic polymer backbone of polyethylene as an adhesive, the adhesive is able to mimic the plastic it is bonding to and it minimizes any separation problems between the plastic and adhesive under high humidity use and storage. Suitable adhesives include, but are not limited to, hot melt adhesives, polyolefin-based glues with a synthetic polymer backbone of polyethylene, rubber-based glues with a styrene-butadiene polymer backbone, and any combinations or mixtures thereof. Suitable adhesive materials, such as TECHNOMELT DM 800B DIPSOMELT and TECHNOMELT DM 106C DIPSOMELT, materials are available from the Henkel Corporation (Düsseldorf, Germany).

Pump assembly 110 may be configured to work in a manner that does not rely on gravity feed of the cleaning composition towards the dispensing orifice 116, as do various existing cleaning devices. Rather, the pump assembly may rely on generation of a suction force upon pressing or other activation of actuator 108, to draw composition 106 into dip tube 112. In one embodiment, the dip tube may be provided at an angle or curved so that in a horizontal orientation, as shown in FIG. 2, the bottom opening dip tube 112 would be closer to surface 120 than the center of the container housing 102. The particular pump mechanism employed in assembly 110 may advantageously be particularly configured so as to reliably operate no matter the orientation of the device, or the orientation of the pump assembly. For example, many existing pump assembly configurations perform poorly, if at all, in so far as effective and accurate dispensing of the desired dose of composition, when the dispensing orifice or delivery channel adjacent thereto is oriented generally horizontally.

As seen in FIG. 2, the delivery channel 114 and orifice 116 are generally horizontal, in order to deliver the cleaning composition 106 into generally vertical substrate 118 (e.g., as it is pressed against a vertical shower wall). FIG. 4A illustrates such use, where the device may typically be oriented vertically, parallel to a shower wall or similar structure being scrubbed. In such an orientation, and even when device 100 is rotated clockwise or counterclockwise 90° (e.g., oriented sideways, 45° degree angle, etc.) in either direction or at any angle in between 0°-90° and 270°-360° the device will continue to reliably dispense the cleaning composition. Such changes in orientation (any orientations therebetween) may be common as a user scrubs up and down, and side to side over a shower wall, bathtub, or similar surface.

Pump assemblies having such desirable operation characteristics are available from various manufacturers. For example, Guala Dispensing (Mt. Pleasant, S.C.) manufactures pump assemblies that may be suitable for use, in conjunction with the actuator 108, delivery channel 114, and orifice 116. Various other pump assemblies providing similar operational characteristics may also be suitable for use.

FIG. 3 shows an exploded view of cleaning device 100, showing a configuration in which the container housing 102 may be provided in two parts, e.g., a lower housing portion 102*a* that includes reservoir 104, and an upper shroud portion 102*b* that may couple to pump assembly 110, and into which actuator 108 may be coupled. As shown, lower housing portion 102*a* may include a hole 122 into which dip tube 112 of pump assembly 110 may be received. Any of various suitable mechanisms may be employed to attach portions 102*b* and 102*a* together, e.g., a bayonet coupling, a snap fit, a screw-on connection, welded connection, use of an adhesive, combinations thereof, etc. A seal may be provided at any such attachment location between housing portion 102*a* and shroud 102*b*, particularly a seal between pump assembly 110 and housing portion 102*a*. Examples of such seals may include, but are not limited to a plug seal, a rib seal, a crab claw seal, a friction seal, combinations thereof, etc. One of skill in the art, in light of the present disclosure, will appreciate various specific configurations that may be employed.

In an embodiment a tight (e.g., air-tight, and/or water-tight) seal may be provided relative to pump assembly 110 and reservoir 104, so as to prevent contamination, backflow, or other issues resulting from undesirable contact or flow between such structures. For example, where the cleaning device 100 is used to clean a shower wall, bathtub or similar surface in the flow of shower water, in bathwater, or even submerged in a bathtub, advantageously the device may prevent such water present from backflowing into the reservoir (e.g., through orifice 116, channel 114, and diptube 112). Prevention of such backflow may be advantageous, particularly where the device 100 is used in such environments where shower water, bath water, etc. may contact the exterior surfaces of the cleaning device. In addition to a seal between assembly 110 and reservoir 104, any valve included in the pump assembly 110 for dispensing the composition may be a one-way valve, so as to prevent backflow.

In an embodiment, the lower housing portion 102*a* including reservoir 104 may be blow molded, injection molded, or otherwise formed from a suitable plastic material. The shroud portion 102*b* may be formed from similar or other suitable manufacturing techniques from a suitable plastic material (e.g., polypropylene, polyethylene, other polyolefins, etc.).

In an embodiment, the lower housing portion 102*a* (e.g., that portion typically gripped by the user) may include an elastomeric grippable portion 124 or material (e.g., over-molded) or otherwise provided over housing portion 102*a*. In an embodiment, such a portion 124 may be provided by an Adflex TPO (thermoplastic polyolefin) which creates soft touch coating. Suitable soft touch coatings may comprise an ethylene-propylene copolymer, 1-propene-ethylene copolymer, or combinations thereof. Various other suitable providers of such grippable, soft touch coatings or materials will be apparent to one of skill in the art. Adflex TPO materials, such as Adflex Q 302 B, soft touch coating materials are available from Lyondellbassell (Houston, Tex.). In one embodiment of the invention, the soft touch material is blended with the HDPE so that the soft touch material is about 5-30% by weight, or about 5-20% by weight or about 5-15% by weight of the soft touch/HDPE blend.

Such grippable portion 124 may include a decorative or other pattern (e.g., raised, embossed, etc.) provided therein. Such grippable portion may aid the user in retaining a good grip on the cleaning device 100, particularly in the contemplated environment, where it may be quite wet. As shown, the sides of housing portion 102*a* may include concavely curved portions 126 on opposite sides, to better facilitate gripping, e.g., between a thumb and finger(s) of a single hand. Such concave portions 126 may further include bumps or protrusions 128 to further improve grip of the device within the hand of a user. The top region of housing portion 102*a* may be convexly curved, to ergonomically fit within the palm portion of the user's hand. The result of such features for improved grip are readily seen in FIG. 4A.

As seen in FIGS. 4A-4B and FIG. 5A-5B, the device 100 may typically be vertically oriented, at least for a portion of the time during cleaning, and also during storage. Such a generally vertical orientation during storage allows the substrate to dry under influence of gravity, as water drains from the substrate downwards, towards the bottom of the device. Such a vertical standing orientation allows the substrate to dry in between uses. In this embodiment, the bottom of the device is flat so that it may easily stand and not tip over in a vertical storage orientation which allows the substrate to dry between uses. Such drying is further aided by the sealed characteristics of the lower container housing portion 102*a*, and the metered dose characteristics, which aid in preventing leakage of composition 106 during storage.

The cleaning composition may typically be an aqueous composition including a surfactant, and water. An organic or mineral acid (e.g., to aid in cleaning) may be included. One or more of a chelating agent, an oxidizing agent (e.g., any peroxide, such as hydrogen peroxide, or a hypochlorite, (e.g., sodium hypochlorite), or hypochlorous acid, or combinations thereof), or one or more other adjuncts selected from the group consisting of fragrances, dyes, preservatives, humectants, solvents, polymers, pH adjusters, solubilizers, and combinations thereof may also be provided.

The composition may have a viscosity so that it may readily be dispensed as described herein. Liquid compositions may have a viscosity of less than 10,000 cps, or less than 1,000 cps. Gel compositions may also be suitable for dispensing as described herein, and may have relatively higher viscosities.

In one embodiment, the composition may have a pH from about 4 to about 8 (about 4, about 5, about 6, about 7, or about 8, or any range defined between any such values). The composition may limit the surfactant concentration to below about 5% by weight. The pH, surfactant concentration, surfactant type, and concentration and/or presence of other components may be specifically configured to ensure that the composition is skin safe so as to not irritate the skin of a user as the user cleans the shower, e.g., even in the flow of the shower water.

Under such conditions, it will be apparent that contact of the cleaning composition with the user's skin is likely to occur. In an embodiment, the composition may be formulated to not irritate the eyes, should the composition get splashed into, or otherwise contact the eye(s) of the user. Such skin safety or eye safety characteristics may be determined by any suitable test, such as by a standard repeat insult patch test (RIPT) test. In an embodiment, the cleaning composition will pass an in vitro dermal irritancy test. In an embodiment, the cleaning composition will pass an in vitro eye irritancy test. In an embodiment, the cleaning composition will pass both an in vitro dermal irritancy test and an in vitro eye irritancy test. Suitable OECD in vitro test methods include but are not limited to: 431 skin corrosion; 430 skin corrosion; 437 BCOP Bovine Corneal Opacity and Permeability; 439 skin irritation, and other tests for skin or eye irritation.

In an alternative embodiment, the composition contains a hypochlorite component and the pH range is between 8 and 14, preferably between 9 and 13, more preferably between 10 and 13. In the embodiment of the invention that contains hypochlorite, the composition in the cleaning device is designed so that the user may dose the substrate directly which minimizes skin contact and any overspray that a user would normally experience with a traditional cleaning tool or sprayer.

In one embodiment, the cleaning composition may include one or more surfactants. Examples include, but are not limited to sulfates, sulfonates, betaines, alkyl polysaccharides, (e.g., alkyl polyglycosides, also known as alkyl polyglucosides), amine oxides, tweens, alcohol ethoxylates, and combinations thereof. One or more of the selected surfactants may provide foam building characteristics. The surfactant concentration may be less than 5% by weight, less than 4%, less than 3%, or less than 2% by weight (e.g., 1% to 2% by weight).

The surfactant(s) may include nonionic, anionic, cationic, ampholytic, amphoteric, zwitterionic surfactants, and mixtures thereof. A typical listing of anionic, ampholytic, and zwitterionic classes, and species of these surfactants, is given in U.S. Pat. No. 3,929,678 to Laughlin. A list of cationic surfactants is given in U.S. Pat. No. 4,259,217 to Murphy. Various alkyl polysaccharide surfactants are disclosed in U.S. Pat. No. 5,776,872 to Giret et al.; U.S. Pat. No. 5,883,059 to Furman et al.; U.S. Pat. No. 5,883,062 to Addison et al.; and U.S. Pat. No. 5,906,973 to Ouzounis et al. U.S. Pat. No. 4,565,647 to Llenado. Various nonionic surfactants can be found in U.S. Pat. No. 3,929,678 to Laughlin. Each of the above patents is incorporated by reference.

An organic acid (e.g., citric acid), or relatively weaker mineral acid (e.g., phosphoric acid) may be included for cleaning. Where included, such an acid may be included in an amount of less than 5%, less than 4%, less than 3%, less than 2% (e.g., from 1% to 2%, or from greater than 0.5% to about 1.5%).

Exemplary organic acid may include 2-hydroxycarboxylic acids or mixtures of two or more acids. Examples of such acids include, but are not limited to, tartaric acid, citric acid, malic acid, mandelic acid, oxalic acid, glycolic acid, lactic acid, and acetic acid. Citric acid, lactic acid, or mixtures thereof may exhibit an antimicrobial effect.

pH adjusters (e.g., sodium hydroxide, or another hydroxide), if present, may typically be included in an amount of less than 3%, less than 2%, less than 1% (e.g., from about 0.5% or greater than 0.5% to 1%). For adjusting pH downward, any of the above described acids may also be suitable for use.

Solubilizers (e.g., to solubilize a fragrance or other oil), if present, may typically be included in an amount of less than 1%, less than 0.5%, less than 0.3% (e.g., from about 0.01% to 0.5%).

Dyes, fragrances, and/or preservatives, if present, may typically be included in an amount of less than 1%, or less than 0.5%. Any other components (e.g., oxidizers, or others mentioned herein) may be present in amounts of less than 10%, less than 5%, less than 4%, less than 3%, less than 2%, less than 1%, or less than 0.5%

Exemplary cleaning composition formulations are shown in Tables 1-3 below, with the balance being water.

TABLE 1

| Component | Function | Weight Percent Active |
|---|---|---|
| Cocamidopropyl betaine | Surfactant/Cleaning/Foam | 0.45-0.75 |
| C8-C16 Alkyl polyglucoside | Surfactant/Cleaning/Foam | 0-0.75 |
| Citric Acid | Cleaning | 0.53-1.50 |
| Sodium Hydroxide | pH Adjuster | 0.59-0.86 |
| Sorbitan Oleate Decylglucoside Crosspolymer | Fragrance Solubilizer | 0-0.2 |
| Methyl chloro isothiazolinone; Methyl isothiazolinone | Preservative | 0.08 |
| Dye | Dye | 0.002 |
| Fragrance | Fragrance | 0.15-0.3 |

TABLE 2

| Component | Function | Weight Percent Active |
|---|---|---|
| Sodium Laureth Sulfate | Surfactant/Cleaning/Foam | 0.25-0.75 |
| C8-C16 Alkyl polyglucoside | Surfactant/Cleaning/Foam | 0.50-2.5 |
| Citric Acid | Cleaning | 0.50-2.50 |
| Sodium Hydroxide | pH Adjuster | 0.40-0.86 |
| Glycerin | Solubilizer | 0-2.0 |
| Methyl chloro isothiazolinone; Methyl isothiazolinone | Preservative | 0.05-0.20 |
| Dye | Dye | 0-0.01 |
| Fragrance | Fragrance | 0.05-0.4 |

TABLE 3

| Component | Function | Weight Percent Active |
|---|---|---|
| Sodium Hypochlorite | Oxidant | 1.0-2.80 |
| Lauryl Dimethylamine Oxide | Surfactant/Cleaning/Foam | 0.2-0.75 |
| Sodium Silicate N | pH Adjuster | 0.0-0.20 |
| Sodium Hydroxide | pH Adjuster | 0.05-0.75 |
| Alkyl Dimethyl Benzyl Ammonium Chloride | Surfactant/Cleaning | 0.10-0.80 |
| Potassium Iodide | Stabilizer | 0.0-0.10 |
| Fragrance | Fragrance | 0.01-0.15 |

The cleaning composition may be effective at cleaning, and removing soils typically present in showers and bathtubs, such as, but not limited to soap scum, hard water stains, mildew, etc. The composition could also be used in other cleaning environments, e.g., such as kitchens, bathroom sinks, walls, etc. In a kitchen environment, the composition may be effective at cleaning and removing kitchen grease. Although described principally in the context of a shower cleaning tool, the cleaning device may be employed for personal care (e.g., delivery of a body wash), auto or other vehicle care (e.g., washing a car, tires, etc.), or in health care (e.g., delivery of an antiseptic wash or other composition to the body). Other surfaces to be cleaned may include bathroom countertops, kitchen countertops, sinks, tables, stovetops, dishes, windows, mirrors, floors, etc.

Figure 4B:
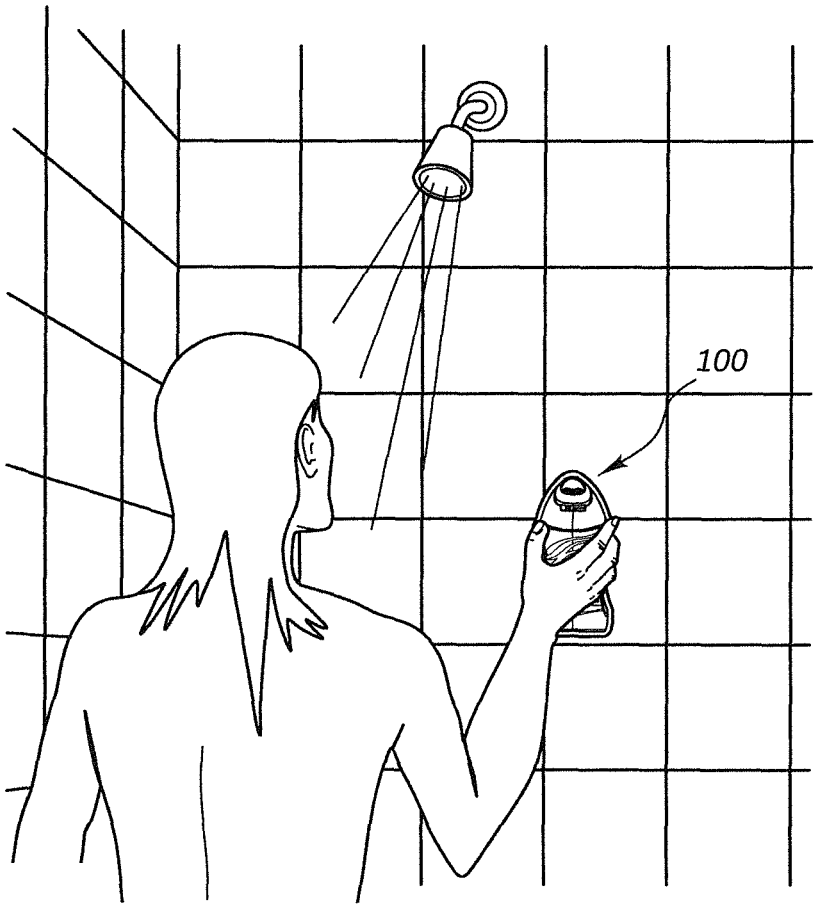

FIGS. 4A-4B illustrate how during use the direct dispensing of the liquid or gel composition onto the scrubber substrate 118 keeps the user in control of where the composition is placed, preventing or minimizing dripping or rinsing away of the composition before the surface is scrubbed clean. As shown, the device allows single handed dispensing and scrubbing operation. The substrate 118 may advantageously be attached over the device where the cleaning composition 106 is dispensed into substrate 118. Direct dispensing of composition 106 into substrate 118 significantly reduces formation of aerosolized particles of the cleaning composition, making the cleaning device more suitable for cleaning of the shower or bathtub in the flow of the shower or bath water. In addition, direct dispensing also reduces and/or eliminates overspray and allows for the user to better control which areas are being contacted and cleaned. Furthermore, direct dispensing into the substrate, rather than generation of significant aerosol is important in reducing the potential for eye irritation.

Such a cleaning method may be performed immediately before, immediately after, or during showering. For example, such cleaning may be performed after showering, before the user exits the shower, dresses, and perhaps even before drying off. Such cleaning before showering may be performed after the user has undressed and stepped into the shower, but the user may choose to clean the shower before himself or herself. In such before the shower cleaning, the shower water may typically be running, with the user in the shower. Of course, the method may also be performed in the flow of shower water, as the user showers. In any case, the user may scrub the desired surfaces, and then rinse the surface (e.g., with shower water).

In an embodiment, the volume of the metered dose dispensed upon a single actuation of the actuator 108 may be from about 0.3 cc to about 1 cc, or from about 0.4 to about 0.8 cc (e.g., about 0.6 cc). The container housing and reservoir may be sized to hold about 8 fl oz to about 12 fl. oz (e.g., about 10 fl oz) of the cleaning composition, which may be sufficient for about 500 metered doses. Such an amount may be sufficient for about 30 uses, of about 15 or 16 doses per shower cleaning use. For example, the cleaning device may be provided prefilled, ready to use, as an all-in-one cleaning tool. Such configuration may not be refillable, to be used for about 30 uses, and then disposed of (e.g., a use of once per day would last about 1 month, a use of once a week would last about 6 months, etc.).

As described above, the substrate 118 and or composition 106 may include an antimicrobial agent therein. Such may aid in sanitizing or disinfecting the surfaces being cleaned. In an embodiment, substrate 118 may include silver ions disposed therein, which silver ions provide an antimicrobial effect. Other antimicrobials may that could be provided in the substrate and/or the cleaning composition may include hypochlorite, quaternary amines, biguanides (e.g., triclosan), etc. The inclusion of such an antimicrobial agent in the substrate may allow the cleaning device to clean and sanitize or disinfect the cleaned surfaces for that period of time it is used (e.g., over a period of about 30 uses). Once all the cleaning composition has been dispensed, the cleaning device may be disposed of.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

The invention claimed is:

1. A cleaning device comprising:

(a) a container housing including a reservoir for holding a cleaning composition;

(b) an actuator disposed at a top end of the container housing;

(c) a pump assembly at least partially disposed within the container housing and in fluid communication with the cleaning composition within the reservoir, the actuator being operably coupled to the pump assembly and configured to dispense a metered dose of the cleaning composition from the reservoir through a dispensing orifice into a substrate;

(d) a substrate attached to a scrubbing surface of the container housing, the substrate being disposed over or about the dispensing orifice so that upon actuation of the actuator, the cleaning composition is dispensed from the reservoir, through the dispensing orifice, and onto or into the substrate;

(e) at least two curved portions located on opposite sides of the container housing; and (f) a lock, wherein said lock is used to prevent inadvertent actuation of said actuator.

2. The cleaning device of claim 1, wherein the substrate is a nonwoven.

3. The cleaning device of claim 1, wherein the at least two curved portions further comprise bumps or protrusions.

4. The cleaning device of claim 1, wherein the cleaning composition has a pH from 4 to 8.

5. The cleaning device of claim 1, wherein the at least two curved portions are concave.

6. The cleaning device of claim 1, wherein the substrate or cleaning composition comprises an antimicrobial agent.

7. The cleaning device of claim 6, wherein the substrate comprises the antimicrobial agent.

8. The cleaning device of claim 7, wherein the antimicrobial agent comprises a quaternary ammonium compound disposed within the substrate.

9. The cleaning device of claim 1, wherein the container housing comprises an elastomeric grippable portion on an exterior surface of the container housing to increase grip of the cleaning device in a hand of a user.

10. The cleaning device of claim 1, wherein the substrate is attached to the scrubbing surface of the cleaning device with an adhesive that tolerates prolonged exposure to relatively high humidity.

11. The cleaning device of claim 1, wherein the pump assembly is configured to prevent backflow into the reservoir.

12. The cleaning device of claim 1, wherein the substrate extends beyond a perimeter of the scrubbing surface of the container housing to facilitate scrubbing of corners.

13. The cleaning device of claim 1, wherein the cleaning device dispenses the cleaning composition to clean a shower immediately before, immediately after, or while a user is showering.

14. A cleaning device comprising:

(a) a container housing including a reservoir for holding a cleaning composition;

(b) an actuator disposed at a top end of the container housing configured to be actuated by a finger of a user as a user grips the container housing;

(c) a pump assembly at least partially disposed within the container housing and in fluid communication with the cleaning composition within the reservoir, the actuator being operably coupled to the pump assembly and configured to dispense a metered dose of the cleaning composition from the reservoir through a dispensing orifice onto or into a substrate upon actuation of the actuator by a user;

(d) a lock, wherein said lock is used to prevent inadvertent actuation of said actuator; and (e) a substrate attached to a generally vertical scrubbing surface of the container housing when the container housing is oriented upright, against a shower wall or other vertical hard surface to be cleaned;

(f) wherein the substrate is disposed over or about the dispensing orifice, which dispensing orifice is oriented generally horizontally relative to the generally vertical scrubbing surface when the container housing is oriented upright, against a shower wall or other vertical hard surface to be cleaned;

(g) wherein upon actuation of the actuator, the cleaning composition is dispensed from the reservoir, through the dispensing orifice, and onto or into the substrate.

15. The cleaning device of claim 14, wherein the substrate is a nonwoven.

16. The cleaning device of claim 14, wherein the cleaning device dispenses the cleaning composition to clean a shower immediately before, immediately after, or while a user is showering.

* * * * *